US010442448B2

(12) United States Patent
Monette et al.

(10) Patent No.: US 10,442,448 B2
(45) Date of Patent: Oct. 15, 2019

(54) HEIGHT ADJUSTABLE SECONDARY SUSPENSION FOR A RAIL VEHICLE

(71) Applicant: BOMBARDIER TRANSPORTATION GMBH, Berlin (DE)

(72) Inventors: Mario Monette, Carignan (CA); Louis Dumoulin, St-Lambert (CA); Benoit Lussier, Ste-Julie (CA)

(73) Assignee: BOMBARDIER TRANSPORTATION GMBH, Berlin (DE)

( * ) Notice: Subject to any disclaimer, the term of this patent is extended or adjusted under 35 U.S.C. 154(b) by 276 days.

(21) Appl. No.: 15/453,682

(22) Filed: Mar. 8, 2017

(65) Prior Publication Data

US 2018/0257678 A1 Sep. 13, 2018

(51) Int. Cl.

| | |
|---|---|
| ***B61F 5/14*** | (2006.01) |
| ***B61F 5/16*** | (2006.01) |
| ***B61F 5/22*** | (2006.01) |

(52) U.S. Cl.

CPC ..... *B61F 5/16* (2013.01); *B61F 5/14* (2013.01); *B61F 5/22* (2013.01)

(58) Field of Classification Search

CPC ..... B61F 5/02; B61F 5/16; B61F 5/14; B61F 5/144; B61F 5/148; B61F 5/22; B60G 17/0272; B60G 2500/30; B60G 2204/4502; B60G 2204/45; B60G 2202/41

USPC ..... 105/397

See application file for complete search history.

(56) References Cited

U.S. PATENT DOCUMENTS

| | | | | |
|---|---|---|---|---|
| 2,719,489 | A * | 10/1955 | Dean | B61C 5/02 105/397 |
| 7,520,494 | B2 | 4/2009 | Gaile | |
| 8,235,366 | B2 * | 8/2012 | Anton | B61F 5/14 267/218 |
| 2016/0176417 | A1 | 6/2016 | Gaile | |

FOREIGN PATENT DOCUMENTS

DE 20 2015 101 275 * 6/2016

OTHER PUBLICATIONS

DE 20 2015 101 275 (English translation of the description section) (Year: 2016).*

* cited by examiner

*Primary Examiner* — Mark T Le
(74) *Attorney, Agent, or Firm* — Benoit & Cote, Inc.; Ibrahim Tamer

(57) ABSTRACT

A secondary suspension system for a railcar comprises a chassis, a primary spring, a levelling actuator, a first hydraulic circuit and a secondary spring. The levelling actuator is adapted to be connected to the carbody. A piston shoulder, located at the lower portion of the piston and below an opening in the chassis, reaches farther than the opening so as to be capable of catching the chassis. The secondary spring is at least partially positioned underneath the piston shoulder. The piston is operative to adopt a high position inside the body under a pressure of a hydraulic fluid injected in a lower chamber below a piston head. This makes the piston shoulder abut against the chassis, thereby compressing the primary spring between the body and the chassis without compressing the secondary suspension.

20 Claims, 4 Drawing Sheets

HEIGHT ADJUSTABLE SECONDARY SUSPENSION FOR A RAIL VEHICLE

FIELD OF THE INVENTION

The present invention generally relates to the field of suspensions for rail vehicles. More specifically, the invention relates to a pull-down system for a secondary suspension of a rail vehicle where the pull-down system is operative to pull the whole carbody down so that it is level with passenger platforms located at different heights at different rail stations.

BACKGROUND OF THE INVENTION

The infrastructure of many train operators dates back from a time when leveled boarding from the passenger platform to a railcar, and vice-versa, was a consideration of second importance, if at all. Often, passengers would need to step up or down inboard a railcar and that was just the way it was. Nowadays however, with accident prevention and easy access for passengers with disabilities being of prime importance, such leveled boarding is an absolute requirement. Consequently, modern vehicles have to be designed to provide this leveled boarding even when used with infrastructure of years gone by.

Height adjusting systems capable of varying the height of a car body have been used for a while. U.S. Pat. No. 7,520,494 to Gaile and U.S. Pat. No. 8,235,366 to Anton disclose a height adjusting systems positioned between a bogie and a body of a railcar capable of precisely pushing upwardly the body at a right level for leveled boarding. However, some railroads require the railcar to run at its highest position between stations because of limited clearance to the ground. Consequently, the height adjusting systems need to continuously operate for the railcar, which would otherwise normally run at its lowest position, to have sufficient clearance to operate on the tracks. This makes the whole train vulnerable in case of failure of the height adjusting system.

Capable of precisely addressing this drawback, published U.S. patent application no. 2016/0176417 to Gaile discloses a height adjusting system capable of pulling down the body of the railcar when in station. Because the railcar runs normally at its highest position, the train is not vulnerable to failure of the height adjusting system. Nevertheless, as disclosed, some components of the height adjusting system are highly stressed when in use, making these components prone to failure.

There is therefore a need for an improved height adjusting system.

SUMMARY OF THE INVENTION

It is an object of the present invention to provide a railcar suspension system that overcomes or mitigates one or more disadvantages of known railcar suspensions systems, or at least provides a useful alternative.

The invention provides the advantages of being capable of compressing its springs so as to lower a floor of a carbody level with a passenger boarding platform.

In accordance with an embodiment of the present invention, there is provided a railcar suspension system adapted to be installed between a bogie and a carbody. This railcar suspension system is particularly designed to be used as a secondary suspension. The railcar suspension system comprises a chassis, a primary spring, a levelling actuator, a first hydraulic circuit and a secondary spring. The chassis, which is adapted to be connected to the bogie, is provided with an opening. The levelling actuator comprises a body adapted to be connected to the carbody and a piston. The body has a spring receiving portion. The primary spring is inserted between the chassis and the spring receiving portion of the body. The piston is operative to slide inside the body. The piston has a piston rod, a piston head and a piston shoulder. The piston rod has a lower portion extending through a bottom of the body and through the opening in the chassis. The piston head is positioned at an upper portion of the piston rod. The piston head defines an upper and a lower chamber inside the body respectively above and below the piston head. The piston shoulder is located at the lower portion of the piston rod and below the opening. The piston shoulder reaches farther than the opening so as to be capable of catching the chassis. The first hydraulic circuit is connected to the lower chamber. The secondary spring is adapted to be at least partially positioned underneath, that is directly under, the piston shoulder.

In use, the piston is operative to adopt a high position inside the body under a pressure of a hydraulic fluid injected in the lower chamber through the first hydraulic circuit. This makes the piston shoulder abut against the chassis, thereby compressing the primary spring between the body and the chassis, but without compressing the secondary suspension.

Preferably, the primary spring may be a coil spring and the secondary spring may be an elastomeric spring. In this case, the opening of the chassis may be positioned substantially centrally in the chassis and the body may be positioned within coils of the coil spring. The spring receiving portion of the body may take the shape of a flat surface extending radially from the body so as to receive the coil spring.

Optionally, the primary spring may comprise two concentric coil springs.

A third spring connected underneath the chassis and adapted to be connected to the bogie may also be used.

Preferably, the secondary spring may be connected to the piston and reach below the piston shoulder or be directly connected underneath the piston shoulder. Alternatively, the secondary spring may be directly attached to the bogie.

The railcar suspension system may comprise a second hydraulic circuit connected to the upper chamber. The piston is then operative to adopt a low position inside the body under a pressure of the hydraulic fluid being injected in the upper chamber through the second hydraulic circuit. The piston, and in particular the piston shoulder, clears the chassis. The secondary spring may abut against the bogie and thereby increase an effective spring rate of the railcar suspension system.

Alternatively to the second hydraulic circuit, a fourth spring could be used inside the upper chamber.

In accordance with another embodiment of the present invention, there is provided a railcar comprising a carbody, a bogie and the secondary suspension system described in the first embodiment of the invention, including all its options, as described here above. The bogie has a bogie frame, a wheel axle having wheels and a primary suspension interconnecting the wheel axle to the bogie frame. The secondary suspension system interconnects the bogie to the carbody. In use, the piston of the secondary suspension system is operative to adopt a high position inside the body under a pressure of a hydraulic fluid injected in the lower chamber through the first hydraulic circuit so that the piston shoulder abuts against the chassis, thereby compressing the primary spring between the body and the chassis and thereby bringing the carbody closer to the bogie.

Optionally, the railcar may be equipped with two secondary suspensions systems where each one of the two secondary suspensions systems is positioned on a different side of the bogie.

Although some railcars may be equipped with a single bogie located at their mid-length, the railcar may more conventionally be equipped with two bogies positioned at a different end of said carbody. Each of the bogie may also conventionally be equipped with two secondary suspension systems, each one being positioned on a different side of the bogie.

BRIEF DESCRIPTION OF DRAWINGS

These and other features of the present invention will become more apparent from the following description in which reference is made to the appended drawings wherein.

DETAILED DESCRIPTION OF THE INVENTION

Figure 1:
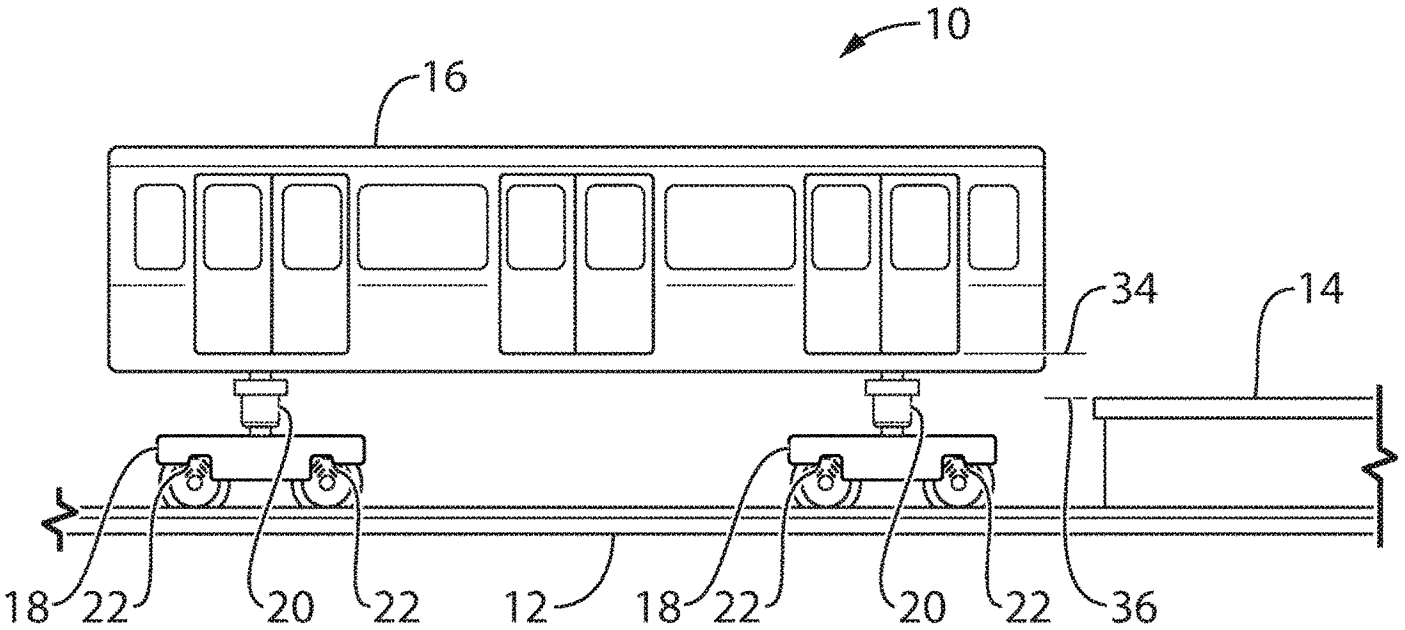
FIG. 1 is a side view of a railcar in its working environment in accordance with an embodiment of the present invention.

The present invention relates to a railcar suspension system designed to be installed between a bogie and a carbody as what is typically called a secondary suspension. This secondary suspension system is capable of compressing itself so as to bring the carbody closer to the bogie. This allows to bring the floor of the carbody level to a passenger platform so as to ease ingress in the railcar.

A railcar 10 is shown travelling on a rail track 12 and about to arrive at a passenger platform 14. The railcar 10 is made of a carbody 16 mounted on a bogie 18 through a secondary suspension 20.

Each railcar 10 is typically equipped with one or two bogies 18. One configuration uses a single bogie 18 longitudinally centered with the carbody 16. Another configuration, the most common, uses two bogies 18 located at a different extremity of the carbody 16. Yet another configuration uses one bogie 18 at each extremity of the carbody 16, but the bogie 18 is centered between two adjacent carbodies 16 so that they support both adjacent carbodies 16. In all these cases, it is possible to equip each bogie 18 with at least one and preferably two secondary suspension systems 20. When two secondary suspension systems 20 are used for each bogie 18, each secondary suspension system 20 is mounted on a different side of the bogie 18.

Figure 2:
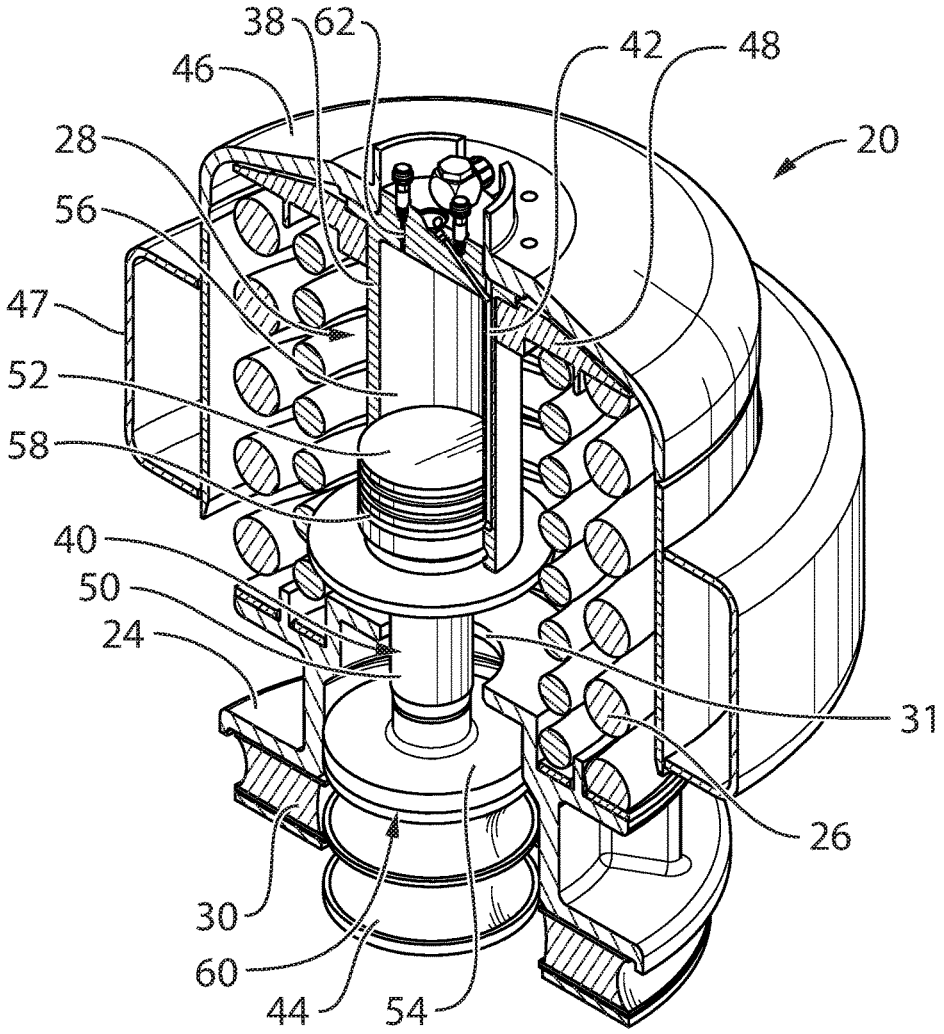
FIG. 2 is a cross-sectional side view of a secondary suspension system of the railcar of FIG. 1.

FIG. 2 is now concurrently referred to. The secondary suspension 20 comprises a chassis 24, a primary spring 26, and a levelling actuator 28.

The chassis 24 is adapted to be connected to the bogie 18, either directly and solidly, or through a third spring 30 which may be made of rubber laminated between steel sheets, similar to a common rubber mount. The chassis 24, which offers a rigid structure on which is mounted the primary spring 26, is provided with an opening 31 located substantially centrally in the chassis 24.

The primary spring 26 may take different forms: leaf spring, air spring, coil spring, etc. In its most common form, and as shown in FIG. 2, the primary spring 26 is a coil spring. More particularly in the present example, the primary spring 26 is actually made of two coil springs, an inner coil spring and an outer coil spring. Using two coil springs instead of just one allows providing added load capacity to support the carbody 16. Rather than being mounted side by side, the two coil springs may be mounted concentrically, as shown, providing a compact assembly.

The levelling actuator 28 allows adjusting the height of the carbody 16. As is shown in FIG. 1, the height of a carbody floor 34 may not match the height of a passenger platform floor 36. Bringing the carbody floor 34 level with the passenger platform floor 36 not only ease walking in and out of the railcar 10, it may also be a requirement in some jurisdictions, especially to accommodate people with disabilities.

Each railcar 10 is typically equipped with four secondary suspension systems 20, one of each being positioned proximate each corner of the railcar 10, between the bogies 18 and the carbody 16. The levelling actuator 28 adjusts the height of the carbody 16 by compressing the primary spring 26. The levelling actuator 28 comprises a body 38, a piston 40, a first hydraulic circuit 42 and a secondary spring 44. As shown, the levelling actuator 28 is of the hydraulic type. However, it could be envisioned that the levelling actuator 28 may also be of a pneumatic or electrical type.

The body 38 of the levelling actuator 28, typically of a cylindrical shape, is designed so that its upper portion is attached to the carbody 16, either directly or indirectly. For example, the upper portion of the body 38 may be attached to the carbody 16 through a housing 46 connected to a bolster 47 as shown in FIG. 2. A spring receiving portion 48 of the body 38, extending radially from the body 38, receives an upper portion of the primary spring 26, which itself sits on the chassis 24. To provide a compact assembly of the secondary suspension system 20, the levelling actuator 28 may be placed centered inside coils of the primary spring 26.

The piston 40 is made of a piston rod 50, a piston head 52 and a piston shoulder 54. The piston head 52 divides an interior of the body 38 into an upper chamber 56 and a lower chamber 58. A lower portion of the piston rod 50 extends through a bottom of the body 38 as well as through the opening 31 in the chassis 24 so that the piston shoulder 54 is positioned below the opening 31. The piston shoulder 54 reaches farther than the opening 31 so that it is capable of interlocking with the chassis 24 when the piston 40 is retracted in the body 38, as will be discussed in more details below. The secondary spring 44 is positioned beneath the piston shoulder 54, either connected to the piston 40 and reaching below a bottom surface 60 of the piston shoulder 54, either directly connected to the bottom surface 60, as shown in FIG. 2, or being attached to the bogie 18 beneath the piston shoulder 54, as in the embodiment of the secondary suspension system 20 depicted in FIGS. 3*a*-3*c*, now concurrently referred to. For example, the secondary spring 44 may be directly connected to the bottom surface 60. The secondary spring 44 may consist of different types of known springs. It has been found that an elastomeric type of spring performs adequately. Interestingly, locating the secondary spring 44 underneath the piston shoulder 54, either directly attached to it or to the bogie 18, provides the advantage of not compressing the secondary spring 44 when the railcar 10 is in station mode (shown in FIG. 3*c*) where the levelling actuator 28 is retracted and the primary spring 26 is compressed.

The first hydraulic circuit 42, adapted to be connected to a source of hydraulic pressure located on the railcar 10 or on an adjacent railcar 10, leads to the lower chamber 58. Similarly, a second hydraulic circuit 62 which is also adapted to be connected to the source of hydraulic pressure, leads to the upper chamber 56. These two hydraulic circuits 42, 62, are used to fill with a hydraulic fluid either the upper chamber 56 or the lower chamber 58 and thereby control the position of the piston 40.

The added weight (AW) concept refers to a load condition of a rail vehicle simulating a given passenger load. In this concept, the following holds:

AW0 simulates an empty car

AW1 simulates a load with seated passengers only

Figure 3C:
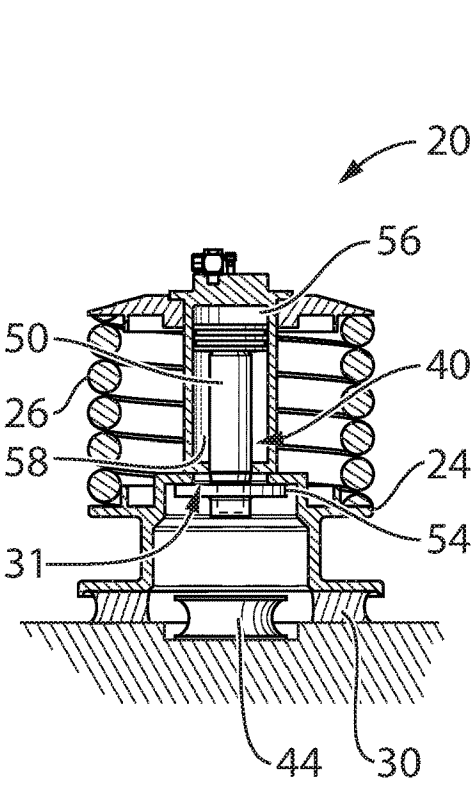
FIG. 3*c* is a cross-sectional side view of the secondary suspension system of FIG. 3*a*, shown in station mode where a primary spring is compressed.
Figure 3B:
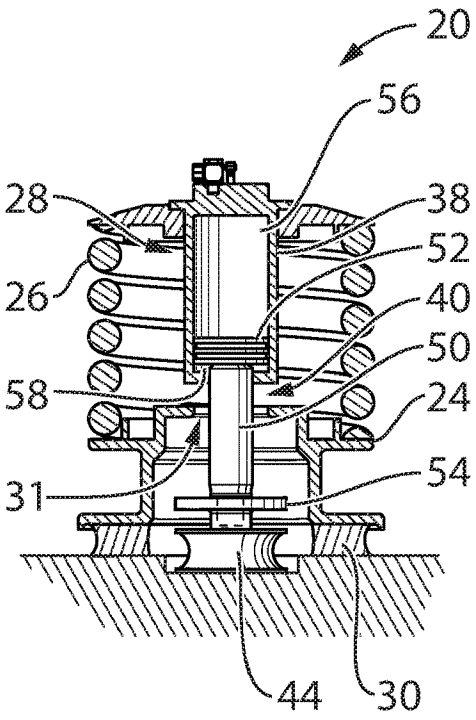
FIG. 3*b* is a cross-sectional side view of the secondary suspension system of FIG. 3*a*, shown in running mode at added weight condition AW3.
Figure 3A:
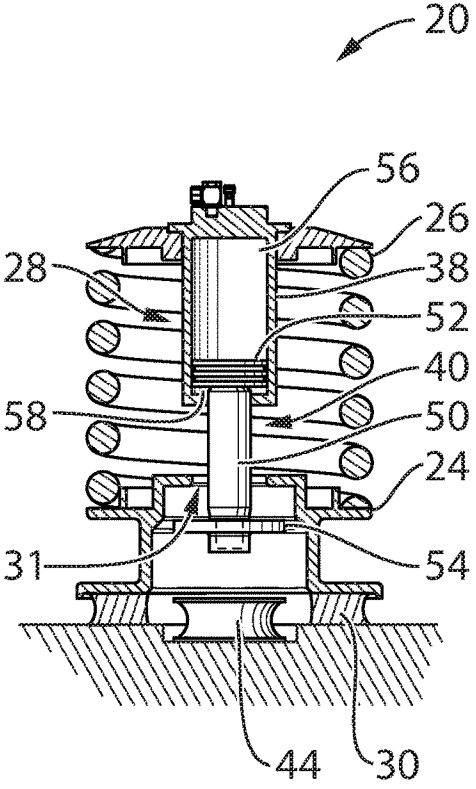
FIG. 3*a* is a cross-sectional side view of a secondary suspension system shown in running mode at added weight condition AW0 in accordance with another embodiment of the present invention.
Figure 4:
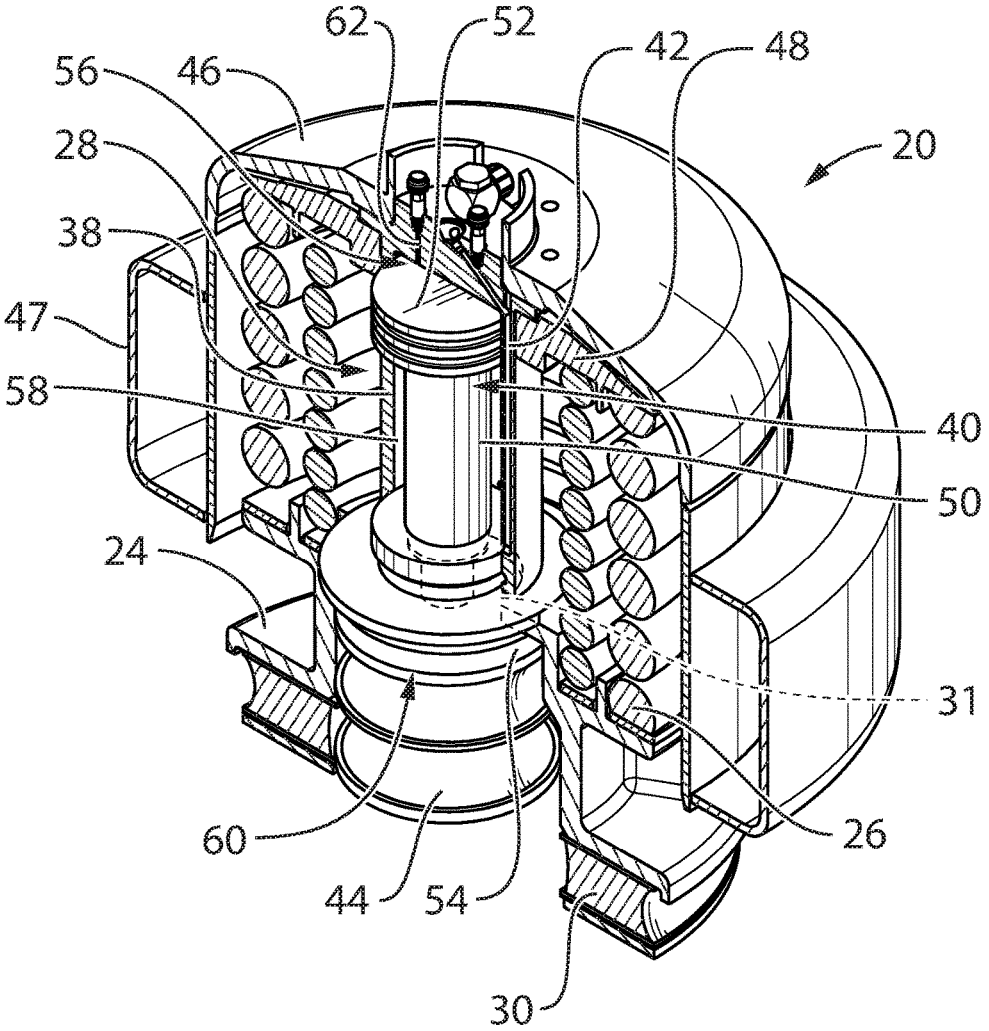
FIG. 4 is a cross-sectional side view of the secondary suspension system of FIG. 2, shown in station mode where a primary spring is compressed.

AW2 simulates a load with some seated and some standing passengers, or approximately 5 passengers/$m^2$ AW3 simulates a train with a maximum number of passengers that can possibly be riding in the railcar, standing and sitting, or approximately 8 passengers/$m^2$ FIG. 3 shows the secondary suspension system 20 in the two extreme loading conditions, that is empty or AW0 (FIG. 3*a*) and fully loaded, or AW3 (FIG. 3*b*). In order to reach the ride quality requirements at AW0, the primary springs 26 must not exceed a specific stiffness. However, this stiffness is not sufficient to prevent the primary springs from bottoming under AW3 loading conditions. One solution is to add the secondary spring 44 which will only be compressed under the AW3 load condition, thereby increasing the stiffness, or the effective spring rate of the secondary suspension 20. FIG. 3*c* shows the secondary suspension 20 in a station mode where the levelling actuator 28 compresses the primary spring 26 so that the carbody 34 is brought level with the passenger platform floor 36. FIG. 4, now concurrently referred to, shows the embodiment of the suspension system 20 depicted in FIG. 2, but in the station mode where the primary spring 26 is compressed by the levelling actuator 28. Except for the mounting of the secondary spring 44, the situation shown FIG. 4 is similar to the one depicted in FIG. 3*c*.

When the railcar 10 is travelling, the upper chamber 56 is filled with the hydraulic fluid so that the piston 40 is at its lowest position within the body 38 and that the primary spring 26 is uncompressed by the levelling actuator 28. FIG. 3*a* shows the secondary suspension 20 when the railcar 10 is travelling at AW0. In this case, the piston shoulder 54, solidary with the whole levelling actuator 28, is free to move up and down with the movements of the primary springs 26. When the railcar 10 is at AW0 and travelling under normal conditions, the vertical distances between the piston shoulder 54, the secondary spring 44 and the chassis 24 are determined so that these components do not get into contact with each other. When the railcar 10 is travelling fully loaded at AW3, as in FIG. 3*b*, the hydraulic fluid still fills the upper chamber 56 so that the piston 40 is biased towards the bottom of the body 38. However, as opposed to the AW0 case, the whole levelling actuator 28 sits closer to the bogie 18 so that the piston shoulder 54 contacts the secondary spring 44 so that the effective stiffness of the secondary suspension 20 is increased, as if the primary spring 26 and the secondary spring 44 were mounted in parallel.

When in station mode, that is when the railcar 10 is stopped at a railway station and that the carbody floor 34 is brought level with the passenger platform floor 36, as shown in FIGS. 3*c* and 4, the hydraulic fluid is evacuated from the upper chamber 56 and pumped under pressure in the lower chamber 58 so that the piston 40 is biased towards the top of the body 38. This forces the piston shoulder 54 to come into contact with the chassis 24 so as to compress the primary spring 26 between the spring receiving portion 48 of the levelling actuator 28 and the chassis 24, thereby lowering the carbody 16. When the railcar 10 is ready to leave, the hydraulic fluid under pressure in the lower chamber 58 is released and pumped under pressure in the upper chamber 56 so that the levelling actuator 28 stops compressing the primary springs 26 and that they regain their normal compression under the combination of carbody and passenger load.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A railcar suspension system adapted to be installed between a bogie and a carbody, the railcar suspension system comprising:

a chassis, said chassis having an opening, said chassis being adapted to be connected to the bogie;

a primary spring;

a levelling actuator, said levelling actuator having:

a body, said body being adapted to be connected to the carbody, said primary spring being inserted between said chassis and a spring receiving portion of said body;

a piston, said piston being operative to slide inside said body, said piston having:

a piston rod, said piston rod having a lower portion extending through a bottom of said body and through said opening in said chassis;

a piston head, said piston head being located at an upper portion of said piston rod, said piston head defining an upper and a lower chamber inside said body respectively above and below said piston head;

a piston shoulder, said piston shoulder being located at said lower portion of said piston rod and below said opening, said piston shoulder reaching farther than said opening so as to be capable of catching said chassis;

a first hydraulic circuit, said first hydraulic circuit being connected to said lower chamber; and a secondary spring, said secondary spring being located on a side of said piston shoulder opposite said piston head, wherein in use, said piston is operative to adopt a high position inside said body under a pressure of a hydraulic fluid injected in said lower chamber through said first hydraulic circuit so that said piston shoulder abuts against said chassis, thereby compressing said primary spring between said body and said chassis without compressing said secondary spring.

2. The railcar suspension system of claim 1 wherein said primary spring is a coil spring and said secondary spring is an elastomeric spring.

3. The railcar suspension system of claim 2 wherein said opening of said chassis is located substantially centrally in said chassis.

4. The railcar suspension system of claim 3 wherein said body is positioned within coils of said coil spring.

5. The railcar suspension system of claim 4 wherein said spring receiving portion of said body extends radially from said body so as to receive said coil spring.

6. The railcar suspension system of claim 1 further comprising a third spring, said third spring being connected underneath said chassis and being adapted for connection to the bogie.

7. The railcar suspension system of claim 1 wherein said secondary spring is connected directly underneath said piston shoulder.

8. The railcar suspension system of claim 1 wherein said secondary spring is adapted to be connected to the bogie.

9. The railcar suspension system of claim 1 further comprising a second hydraulic circuit, said second hydraulic circuit being connected to said upper chamber, said piston being operative to adopt a low position inside said body under a pressure of a hydraulic fluid injected in said upper chamber through said second hydraulic circuit so that said piston clears said chassis and so that said secondary spring may abut against the bogie and thereby increase an effective spring rate of the railcar suspension system.

10. A railcar comprising:

a carbody;

a bogie, said bogie having a primary suspension;

a secondary suspension system, said secondary suspension system interconnecting said bogie to said carbody, said secondary suspension system having:

a chassis, said chassis having an opening, said chassis being adapted to be connected to the bogie;

a primary spring;

a levelling actuator, said levelling actuator having:

a body, said body being adapted to be connected to the carbody, said primary spring being inserted between said chassis and a spring receiving portion of said body;

a piston, said piston being operative to slide inside said body, said piston having:

a piston rod, said piston rod having a lower portion extending through a bottom of said body and through said opening in said chassis;

a piston head, said piston head being located at an upper portion of said piston rod, said piston head defining an upper and a lower chamber inside said body respectively above and below said piston head;

a piston shoulder, said piston shoulder being located at said lower portion of said piston rod and below said opening, said piston shoulder reaching farther than said opening so as to be capable of catching said chassis;

a first hydraulic circuit, said first hydraulic circuit being connected to said lower chamber; and a secondary spring, said secondary spring being located on a side of said piston shoulder opposite said piston head, wherein in use, said piston is operative to adopt a high position inside said body under a pressure of a hydraulic fluid injected in said lower chamber through said first hydraulic circuit so that said piston shoulder abuts against said chassis, thereby compressing said primary spring between said body and said chassis without compressing said secondary spring and thereby bringing said carbody closer to said bogie.

11. The railcar of claim 10 wherein said primary spring is a coil spring and said secondary spring is an elastomeric spring.

12. The railcar of claim 11 wherein said opening of said chassis is located substantially centrally in said chassis.

13. The railcar of claim 12 wherein said body is positioned within coils of said coil spring.

14. The railcar of claim 13 wherein said spring receiving portion of said body extends radially from said body so as to receive said coil spring.

15. The railcar of claim 10 further comprising a third spring, said third spring being connected underneath said chassis and being connected to said bogie.

16. The railcar of claim 10 wherein said secondary spring is connected directly underneath said piston shoulder.

17. The railcar of claim 10 wherein said secondary spring is connected to said bogie.

18. The railcar of claim 10 further comprising a second hydraulic circuit, said second hydraulic circuit being connected to said upper chamber, said piston being operative to adopt a low position inside said body under a pressure of a hydraulic fluid injected in said upper chamber through said second hydraulic circuit so that said piston clears said chassis and so that said secondary spring may abut against said bogie and thereby increase an effective spring rate of the secondary suspension system.

19. The railcar of claim 10 comprising two said secondary suspensions systems, each one of said two secondary suspensions systems being positioned on a different side of said bogie.

20. The railcar of claim 19 comprising two said bogies, each one of said two bogies being positioned at a different end of said carbody.

* * * * *